US007587854B2

(12) United States Patent
Werner

(10) Patent No.: US 7,587,854 B2
(45) Date of Patent: Sep. 15, 2009

(54) GAS-DAMPENED RECOIL REST WITH REMOTE TRIGGER RELEASE

(76) Inventor: Theodore J. Werner, 193 W. Hills Rd., Huntington Station, NY (US) 11746

( * ) Notice: Subject to any disclaimer, the term of this patent is extended or adjusted under 35 U.S.C. 154(b) by 307 days.

(21) Appl. No.: 11/637,554

(22) Filed: Dec. 12, 2006

(65) Prior Publication Data

US 2008/0134555 A1 Jun. 12, 2008

(51) Int. Cl.
*F41A 27/00* (2006.01)
*F41A 19/55* (2006.01)

(52) U.S. Cl. ..... 42/94; 42/69.01

(58) Field of Classification Search ..... 42/94, 42/69.01; 89/37.04
See application file for complete search history.

(56) References Cited

U.S. PATENT DOCUMENTS 2,284,611 A * 5/1942 Barnhart ..... 89/41.02
2,427,365 A * 9/1947 Meister ..... 269/152
2,599,265 A * 6/1952 Leek ..... 89/43.01
3,358,504 A * 12/1967 Freebairn ..... 73/167
3,827,172 A * 8/1974 Howe ..... 42/94
4,012,860 A * 3/1977 Auger ..... 42/94
4,333,385 A * 6/1982 Culver ..... 89/37.04
5,220,116 A * 6/1993 Sheets ..... 42/94
5,272,955 A * 12/1993 Bond et al. ..... 89/37.04
6,293,041 B2 * 9/2001 Weaver ..... 42/94
2004/0020097 A1 * 2/2004 Deros ..... 42/94
2005/0066808 A1 * 3/2005 Hawkes et al. ..... 89/41.05

* cited by examiner

*Primary Examiner*—Bret Hayes
(74) *Attorney, Agent, or Firm*—Charles E. Baxley

(57) ABSTRACT

A gas-dampened recoil rest with remote trigger release for a rifle for allowing a shooter to fire the rifle without any human contact and possible motion contamination. The rest includes a gas-dampened recoil rest and a remote trigger release. The gas-dampened recoil rest stationarily receives the rifle. The remote trigger release is operatively connected to the rifle, and together with the gas-dampened recoil rest, allow the shooter to fire the rifle without any human contact and possible motion contamination.

32 Claims, 9 Drawing Sheets

GAS-DAMPENED RECOIL REST WITH REMOTE TRIGGER RELEASE

BACKGROUND OF THE INVENTION

A. Field of the Invention

The embodiments of the present invention relate to a rest for a rifle, and more particularly, the embodiments of the present invention relate to a gas-dampened recoil rest with remote trigger release for a rifle for allowing a shooter to fire the rifle without any human contact and possible motion contamination.

B. Description of the Prior Art

Various forms of adjustable rifle rests have been heretofore provided to enable rifle sights to be properly adjusted and also to enable close checking of the accuracy of the rifle.

Whenever hunters, marksmen, or users of firearms use a rifle, the sights must be aligned relative to the rifle to assure the accuracy of the rifle. Preferably, the sights are adjusted independent of the shooter. Later detected inaccuracies can then be directed to correcting deficiencies in the shooter's form or technique or the rifle can be compensated for the shooter in a known manner and not by mere guess.

The immobilization of rifles by way of portable devices is conventionally performed by way of gun mounts, bipods, tripods, or trestles, on which loads, such as bags of sand, rocks, etc can be disposed in order to improve the stability of the assembly, of which, however, the stability is random, since the configuration of these support systems does not permit accommodation of large additional loads. Nevertheless, the efficiency of an immobilizing device continues to be proportional to its weight, as well as to its capacity for clamping effectively the rifle it receives.

In fact, at the beginning of each shot, the rifle is subjected to stresses taking the form of violent displacements, and the barrel withstands complex vibratory movements, of which the amplitude and frequency have a determining influence on the distribution of the impacts on the target. It is thus obvious that in order to follow an identical trajectory, all the projectiles must clear the mouth of the barrel of the rifle at the moment when the mouth of the barrel of the rifle occupies a single position in space. For this purpose, a device that is as stable as possible, must confer on the rifle a maximum level of immobility between and during each shot in order for the corrections made on the rifle, and particularly on its sighting units, to take place from a known constant reference position.

Many devices have been developed for holding a rifle in position during firing of the rifle and absorbing the recoil forces of the rifle. These devices can be useful in a variety of circumstances, for example, they can be used to adjust the gun sights or to test the mechanical integrity and accuracy of the rifle itself.

Numerous innovations for rifle shooting and related devices have been provided in the prior art that will be described below, which are in chronological order to show advancement in the art, and which are incorporated herein by reference thereto. Even though these innovations may be suitable for the specific individual purposes to which they address, they each differ in structure, and/or operation, and/or purpose from the embodiments of the present invention, in that they do not teach a gas-dampened recoil rest with remote trigger release for a rifle for allowing a shooter to fire the rifle without any human contact and possible motion contamination.

(1) U.S. Pat. No. 3,668,871 to Berndt et al.

U.S. Pat. No. 3,668,871 issued to Berndt et al. on Jun. 13, 1972 in class 60 and subclass 54.5 R teaches an hydraulic remote control apparatus for use in operating short-stroke valves located in the piston of an adjustment cylinder. The apparatus includes a pair of remotely located hydraulic chambers interconnected by way of a fluid-carrying conduit. A first hydraulic chamber is provided with a diaphragm and disk arrangement spanning the chamber to form fluid-tight operating and control compartments therein. A second hydraulic chamber has a smaller cross-section than the first chamber and is provided with a rolling elastomeric diaphragm, so that the volume of the second hydraulic chamber can be reduced by displacement of the plunger in a manner sufficient to deflect the rolling diaphragm.

(2) U.S. Pat. No. 4,012,860 to Auger

U.S. Pat. No. 4,012,860 issued to Auger on Mar. 22, 1977 in class 42 and subclass 94 teaches a lower base and an elongated generally horizontal support member oscillatably supported from the base for angular displacement about a generally horizontal axis. The support member extends in a direction transverse to the axis of oscillation thereof and includes structure spaced above its axis of oscillation for removably stationarily supporting a rifle therefrom, with the rifle extending longitudinally of the support member. Adjustment structure is operatively connected between the base and the support member for infinite angular adjustment of the support member relative to the base, throughout at least a limited sector of adjustment. In addition, an electric-motor-driven structure is also provided for removable support from a rifle supported from the support member and includes features for operative association with the trigger of the associated rifle, whereby the trigger may be gradually actuated without causing vibration of the rifle.

(3) U.S. Pat. No. 4,196,653 to Jackson

U.S. Pat. No. 4,196,653 issued to Jackson on Apr. 8, 1980 in class 89 and subclass 136 teaches an auxiliary firing mechanism used to actuate a tripper for a gun trigger, including a remote actuator connected to the tripper by an elongated connector, such as a cable, that is moved by the cooperable action of a control member and a rotatably and axially movable actuator member of the actuator. Camming surfaces of the control member and the actuator member of the actuator move the control member from a first position to a second position against a spring bias thereof in order to actuate the tripper and thereby trip the gun trigger whereupon the camming surface of the actuator member moves out of engagement with the camming surface of the control member in order to allow the control member to be moved back to the first position by its spring bias. Axial and rotational movement of the actuator member then again engages the camming surfaces of the control and actuator members in preparation for another actuation of the tripper. A manually movable lever, preferably having a foot pedal, rotates the actuator member to provide the tripper actuation.

(4) U.S. Pat. No. 4,409,826 to Wenger

U.S. Pat. No. 4,409,826 issued to Wenger on Oct. 18, 1983 in class 73 and subclass 167 teaches a test-firing apparatus, including a weapon-holder accommodating a rifle or handgun and a, preferably, freely mobile mounting for the holder in relation to a stationary base. A projecting support apparatus connected to the weapon allows the recoil-pulse to be absorbed in conjunction with the freely mobile mounting by the body of an operator as in practical shooting. The only purpose of the mounting, preferably in the form of a linearprecision guide including cross rollers, is to position the barrel-axis directionally, and the mounting is therefore subjected to little stress. Resilient and/or damping absorption of the recoil-pulse may also be provided. The barrel-axis is arranged in parallel with the movement-axis of the mounting, so that the point of impact of the bullet upon the target cannot be affected by the recoil-stroke. This parallelism may be adjusted by optical apparatus, preferably by way of a reference-weapon fitted to the weapon-holder. The barrel-axis of the reference-weapon is fixed parallel with the movement-axis by way of appropriate indexing elements. This indirect alignment is achieved by comparing the shot-patterns of the two weapons.

(5) U.S. Pat. No. 5,070,636 to Mueller

U.S. Pat. No. 5,070,636 issued to Mueller on Dec. 10, 1991 in class 42 and subclass 94 teaches a weapon sighting assembly, including a longitudinally extending frame rotatively secured under tension about a shock plate coupling the assembly to a grounded support. A resiliently supported barrel rest is adjustably mounted along the longitudinal frame. A weapon receiving cradle includes a compressive elastomeric pad and surfaces conforming to the aft end of the weapon and the marksperson's hand and/or shoulder. Cant adjustment apparatus is provided at the shock plate, windage adjustment apparatus couples to the longitudinal frame, and a resilient strap can be used to further couple a weapon to the assembly.

(6) U.S. Pat. No. 5,272,955 to Bond et al.

U.S. Pat. No. 5,272,955 issued to Bond et al. on Dec. 28, 1993 in class 89 and subclass 37.04 teaches a portable apparatus attachable to a wheelchair for movably supporting a gun thereon, including a pneumatic/hydraulic fluid-operated control circuit for operably controlling the direction of the gun while sitting in the wheelchair. The apparatus includes a support adapted to attach to the wheelchair and support a gun, and further includes a control system including an hydraulic linear actuator and an hydraulic rotary actuator operably connected to the support, an air tank operably connected through control valves and air/oil chambers to the actuators, and controls including a joystick that can be readily manipulated by the person in the wheelchair to move the control valves and thereby controllably actuate the actuators to aim the gun. A pair of oil-interlock valves are operably connected to either side of each of the actuators to securely locate the gun in a given position once aimed.

(7) U.S. Pat. No. 5,375,804 to Levilly

U.S. Pat. No. 5,375,804 issued to Levilly on Dec. 27, 1994 in class 248 and subclass 274 teaches a portable device for immobilizing individual firearms during adjustment firing. The device includes a seating intended to be attached to an existing support by attachment apparatus. The seating supports, so as to pivot about a first axis, a plate accommodating a rail that in turn is mounted so as to pivot on the plate about a second axis that is perpendicular to the first axis. The rail receives, in a sliding manner along its axis, at least two plates with adjustment slides. The slides are perpendicular to the axis of the rail and to the axis of pivoting of the rail. A U-shaped support is mounted in the slide of each plate and is provided with attachment apparatus intended to accommodate the weapon to be adjusted.

(8) U.S. Pat. No. 5,811,720 to Quinnell et al.

U.S. Pat. No. 5,811,720 issued to Quinnell et al. on Sep. 22, 1998 in class 89 and subclass 37.04 teaches a shooting rest for a rifle for absorbing the recoil produced when the rifle is fired. The rest includes a rifle mounting structure, a base structure, and a swivel plate. The rifle is secured to the rifle mounting structure having a mechanism for adjusting the elevation of the rifle barrel resting thereon. The rifle mounting structure is slidably engaged to the base structure, so that the rifle mounting structure may slide backwards in response to the recoil from firing the rifle. The recoil energy from the rifle is absorbed by several rubber balls when a first bracket mounted to the rifle mounting structure is forced backwards towards the rubber balls, which are held in position by a second bracket mounted to the base structure. The base structure may be mounted on a plate swivable around a vertical axis allowing the rifle to be aimed in different horizontal directions. The swivel plate can be adjustably secured to the edge of a shooting table so that the shooting rest may be used at any rifle range or on any relatively flat surface without permanently attaching it to the surface.

It is apparent that numerous innovations for rifle shooting and related devices have been provided in the prior art that are adapted to be used. Furthermore, even though these innovations may be suitable for the specific individual purposes to which they address, they would not be suitable for the purposes of the embodiments of the present invention as heretofore described, namely, a gas-dampened recoil rest with remote trigger release for a rifle for allowing a shooter to fire the rifle without any human contact and possible motion contamination.

SUMMARY OF THE INVENTION

Thus, an object of the embodiments of the present invention is to provide a gas-dampened recoil rest with remote trigger release for a rifle for allowing a shooter to fire the rifle without any human contact and possible motion contamination that avoids the disadvantages of the prior art.

Briefly stated, another object of the embodiments of the present invention is to provide a gas-dampened recoil rest with remote trigger release for a rifle for allowing a shooter to fire the rifle without any human contact and possible motion contamination. The rest includes a gas-dampened recoil rest and a remote trigger release. The gas-dampened recoil rest stationarily receives the rifle. The remote trigger release is operatively connected to the rifle and together with the gas-dampened recoil rest allow the shooter to fire the rifle without any human contact and possible motion contamination.

The novel features considered characteristic of the embodiments of the present invention are set forth in the appended claims. The embodiments of the present invention themselves, however, both as to their construction and their method of operation together with additional objects and advantages thereof will be best understood from the following description of the specific embodiments when read and understood in connection with the accompanying drawing.

BRIEF DESCRIPTION OF THE DRAWING

The figures of the drawing are briefly described as follows.

LIST OF REFERENCE NUMERALS UTILIZED IN THE DRAWING

A. General

Figure 1:
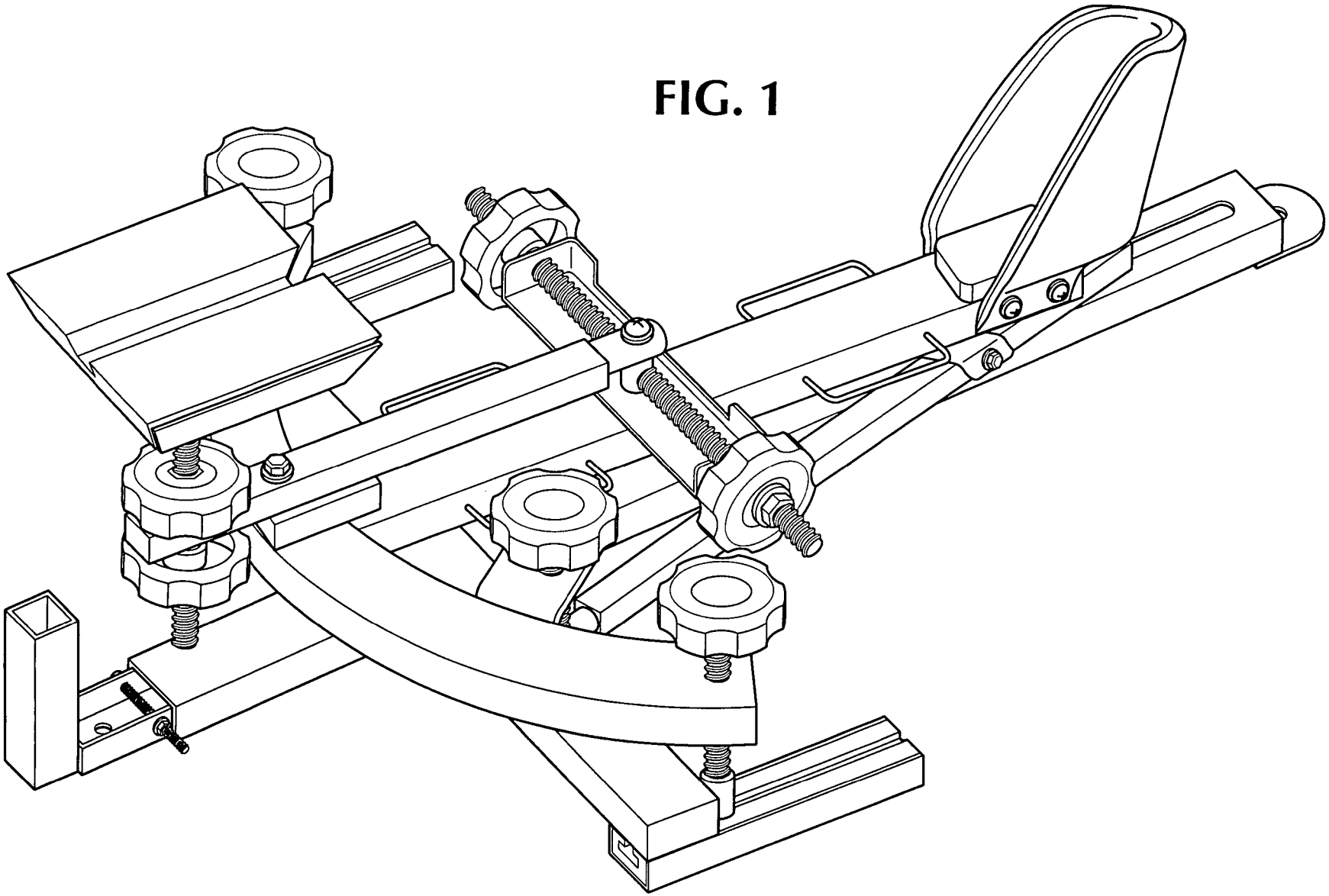
FIG. 1 is a diagrammatic perspective view of the gas-dampened recoil rest with remote trigger release of the embodiments of the present invention with a rifle therein so as to allow a shooter to fire the rifle without any human contact and possible motion contamination.

10 gas-dampened recoil rest with remote trigger release of embodiments of present invention rifle 12 for allowing shooter (not shown) to fire rifle 12 without any human contact and possible motion contamination

12 rifle

14 gas-dampened recoil rest for stationarily receiving rifle 12

16 remote trigger release for operatively connecting to rifle 12 and together with gas-dampened recoil rest 14 allow shooter to fire rifle 12 without any human contact and possible motion contamination B. Gas-Dampened Recoil Rest 14

18 first apparatus for securing rifle 12 to unyielding surface 20

20 unyielding surface

22 second apparatus for adjusting rifle 12 vertically relative to unyielding surface 20

24 third apparatus for windage adjusting rifle 12 horizontally relative to unyielding surface 20

26 fourth apparatus for cant adjusting of rifle 12 relative to unyielding surface 20

(1) First Apparatus 18

28 stationary lower frame

30 spine of stationary lower frame 28 for resting on unyielding surface 20

32 cross member of stationary lower frame 28

34 leading end of spine 30 of stationary lower frame 28

36 trailing end of spine 30 of stationary lower frame 28

38 pair of terminal ends of cross member 32 of stationary lower frame 28

40 arm of stationary lower frame 28

42 extender of arm 40 of stationary lower frame 28

44 grip of arm 40 of stationary lower frame 28 for gripping end 48 of unyielding surface 20

46 terminal end of extender 42 of arm 40 of stationary lower frame 28

48 end of unyielding surface 20

50 leading end of stationary lower frame 28

52 flange of stationary lower frame 28

54 through bore through flange 52 of stationary lower frame 28 for receiving fastener 56 for engaging into unyielding surface 20 to thereby affix trailing end 58 of stationary lower frame 28 to unyielding surface 20

56 fastener for engaging into unyielding surface 20 to thereby affix trailing end 58 of stationary lower frame 28 to unyielding surface 20

58 trailing end of stationary lower frame 28

(2) Second Apparatus 22

60 movable carrier frame

62 spine of movable carrier frame 60

64 cross member of movable carrier frame 60

66 leading end of spine 62 of movable carrier frame 60

68 trailing end of spine 62 of movable carrier frame 60

70 pair of terminal ends of cross member 64 of movable carrier frame 60

72 butt socket of movable carrier frame 60 for receiving butt of rifle 12

74 gas damper of movable carrier frame 60 for absorbing recoil when rifle 12 is fired

76 fixed end of gas damper 74 of movable carrier frame 60

78 movable end of gas damper 74 of movable carrier frame 60

80 telescopic arm of movable carrier frame 60

82 rear end of telescopic arm 80 of movable carrier frame 60

83 front end of telescopic arm 80 of movable carrier frame 60

84 first adjusting screw assembly of movable carrier frame 60

86 tab of first adjusting screw assembly 84 of movable carrier frame 60

88 adjusting screw of first adjusting screw assembly 84 of movable carrier frame 60

(3) Third Apparatus 24

90 frame

92 cross member of frame 90

94 telescopic arm of frame 90

96 pair of terminal ends of cross member 92 of frame 90

98 front end of telescopic arm 94 of frame 90

100 center of cross member 64 of movable carrier frame 60

102 rear end of telescopic arm 94 of frame 90

104 second adjusting screw assembly of frame 90

106 front rest of frame 90

108 padded rest of front rest 106 of frame 90

110 third adjusting screw assembly of front rest 106 of frame 90

112 threaded rod of third adjusting screw assembly 110 of front rest 106 of frame 90

114 pair of second knobs of third adjusting screw assembly 110 of front rest 106 of frame 90

116 upper terminal end of threaded rod 112 of third adjusting screw assembly 110 of front rest 106 of frame 90

118 adjusting screw of second adjusting screw assembly 104 of frame 90

120 threaded rod of adjusting screw 118 of second adjusting screw assembly 104 of frame 90

122 pair of third knobs of adjusting screw 118 of second adjusting screw assembly 104 of frame 90

124 pair of terminal ends of threaded rod 120 of adjusting screw 118 of second adjusting screw assembly 104 of frame 90

(4) Fourth Apparatus 26

126 pair of fourth adjusting screw assemblies

128 pair of bases of pair of fourth adjusting screw assemblies 126, respectively

130 pair of adjusting screws of pair of fourth adjusting screw assemblies 126, respectively.

132 pair of threaded rods of pair of adjusting screws 130 of pair of fourth adjusting screw assemblies 126, respectively

134 pair of fourth knobs of pair of adjusting screws 130 of pair of fourth adjusting screw assemblies 126, respectively

136 upper ends of pair of threaded rods 132 of pair of adjusting screws 130 of pair of fourth adjusting screw assemblies 126, respectively C. Remote Trigger Release 16

138 slave cylinder for operatively connecting to trigger of rifle 12

140 master cylinder for positioning remote from trigger of rifle 12 so as to allow slave cylinder 138 to activate and activate trigger of the rifle 12 when master cylinder 140 is activated remotely to thereby eliminate any human contact and possible motion contamination

142 conduit

144 trigger-activating plunger of slave cylinder 138

145 normally bent rod of trigger-activating plunger 144 of slave cylinder 138 for operatively connecting to trigger of rifle 12

146 plunger of master cylinder 140 for manually depressing by shooter to activate master cylinder 140

148 hydraulic fluid

150 clamp assembly for attaching slave cylinder 138 to trigger guard of rifle 12 in such position so as allow normally bent rod 145 of trigger-activating plunger 144 of slave cylinder 138 to engage trigger of rifle 12

DETAILED DESCRIPTION OF THE PREFERRED EMBODIMENTS

A. General

Referring now to the figures, in which like numerals indicate like parts, and particularly to FIG. 1, which is a diagrammatic perspective view of the gas-dampened recoil rest with remote trigger release of the embodiments of the present invention with a rifle therein so as to allow a shooter to fire the rifle without any human contact and possible motion contamination, the gas-dampened recoil rest with remote trigger release of the embodiments of the present invention is shown generally at 10 for a rifle 12 for allowing a shooter (not shown) to fire the rifle 12 without any human contact and possible motion contamination.

The gas-dampened recoil rest with remote trigger release 10 comprises a gas-dampened recoil rest 14 and a remote trigger release 16. The gas-dampened recoil rest 14 is for stationarily receiving the rifle 12. The remote trigger release 16 is for operatively connecting to the rifle 12, and together with the gas-dampened recoil rest 14, allow the shooter to fire the rifle 12 without any human contact and possible motion contamination.

B. The Gas-Dampened Recoil Rest 14

Figure 2:
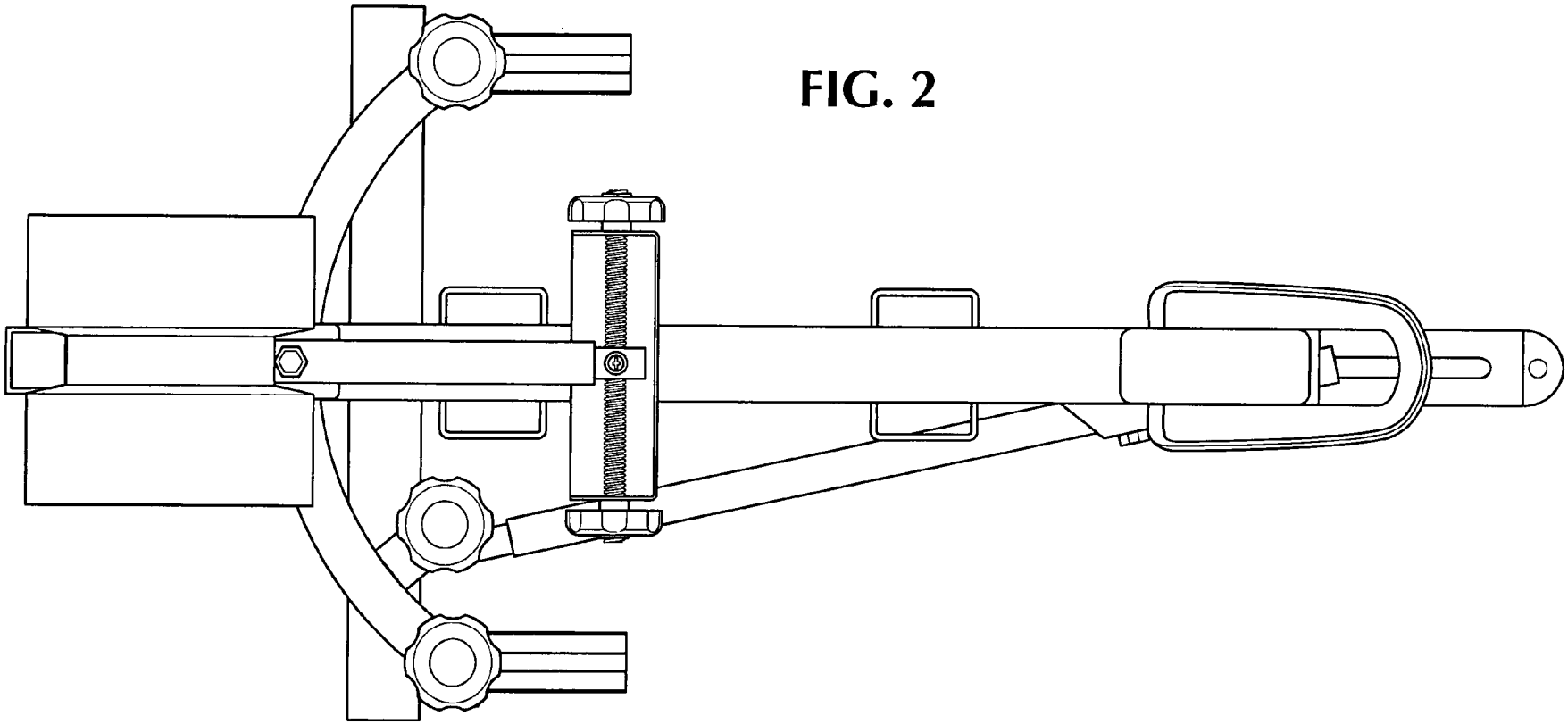
FIG. 2 is an enlarged diagrammatic perspective view of the gas-dampened recoil rest identified by ARROW 2 in FIG. 1.
Figure 3:
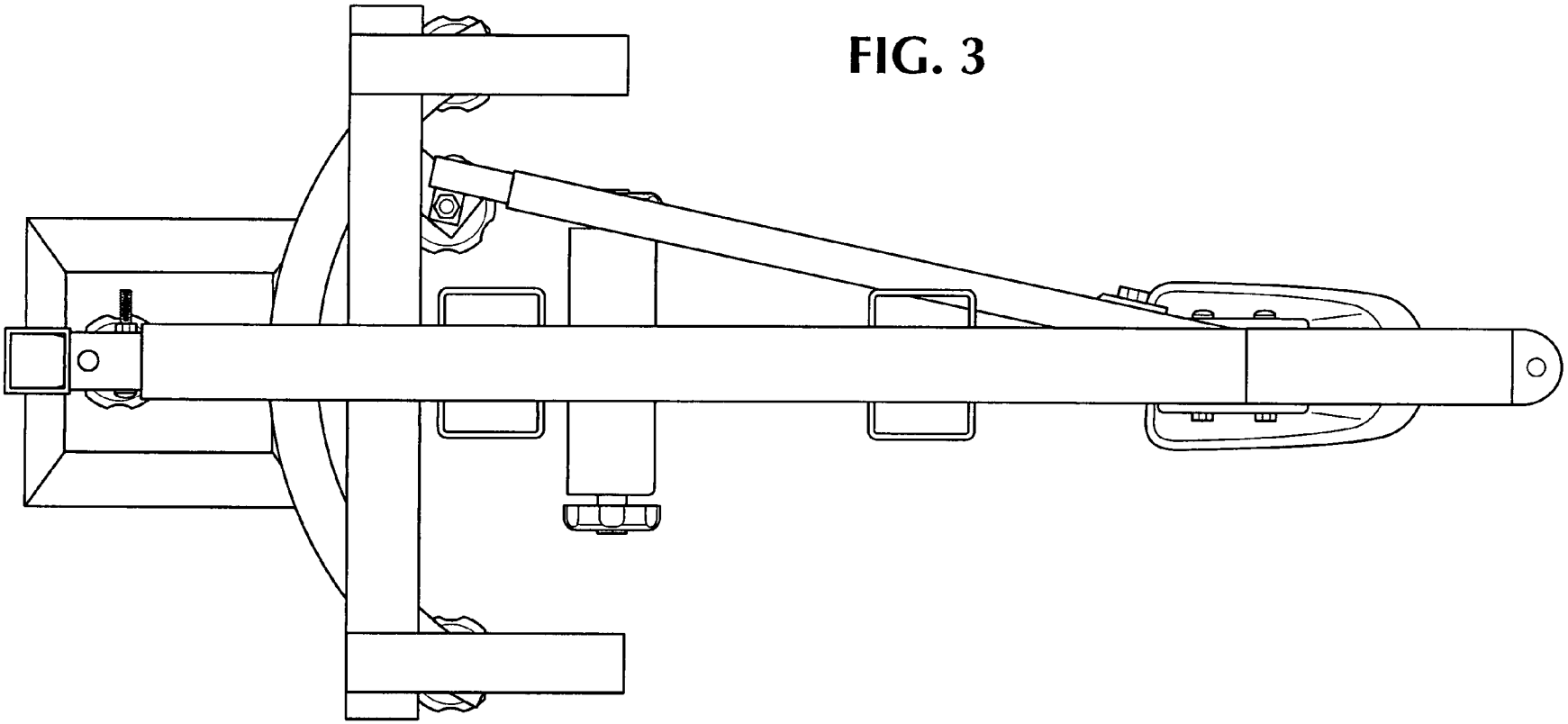
FIG. 3 is a diagrammatic top plan view taken generally in the direction of ARROW 3 in FIG. 2.
Figure 4:
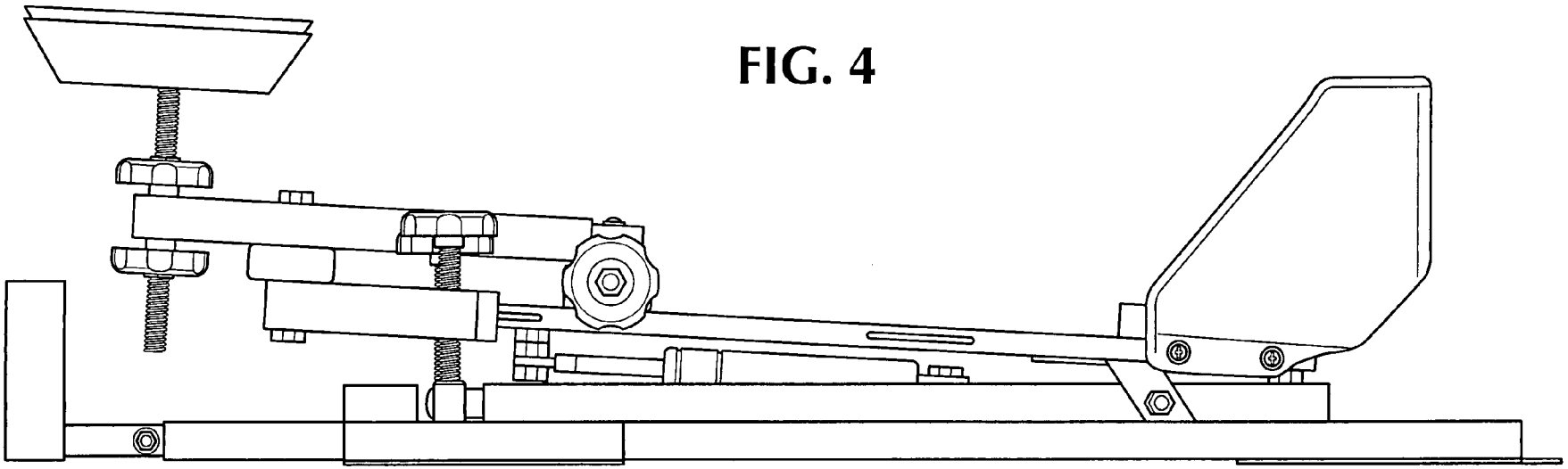
FIG. 4 is a diagrammatic bottom plan view taken generally in the direction of ARROW 4 in FIG. 2.
Figure 5:
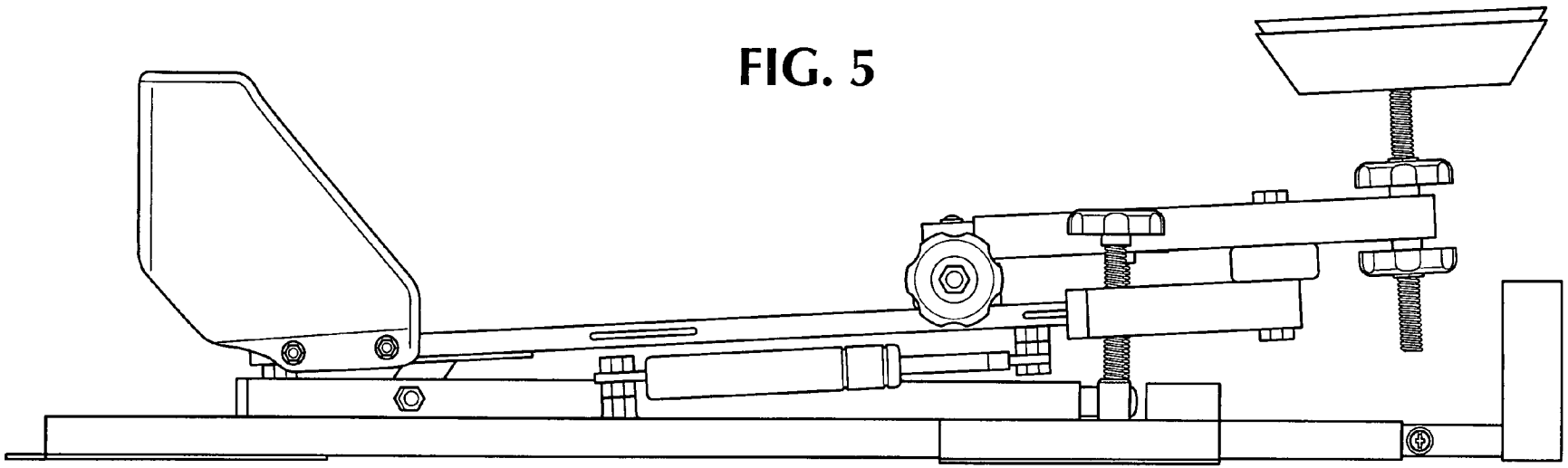
FIG. 5 is a diagrammatic right side elevational view taken generally in the direction of ARROW 5 in FIG. 2.
Figure 6:
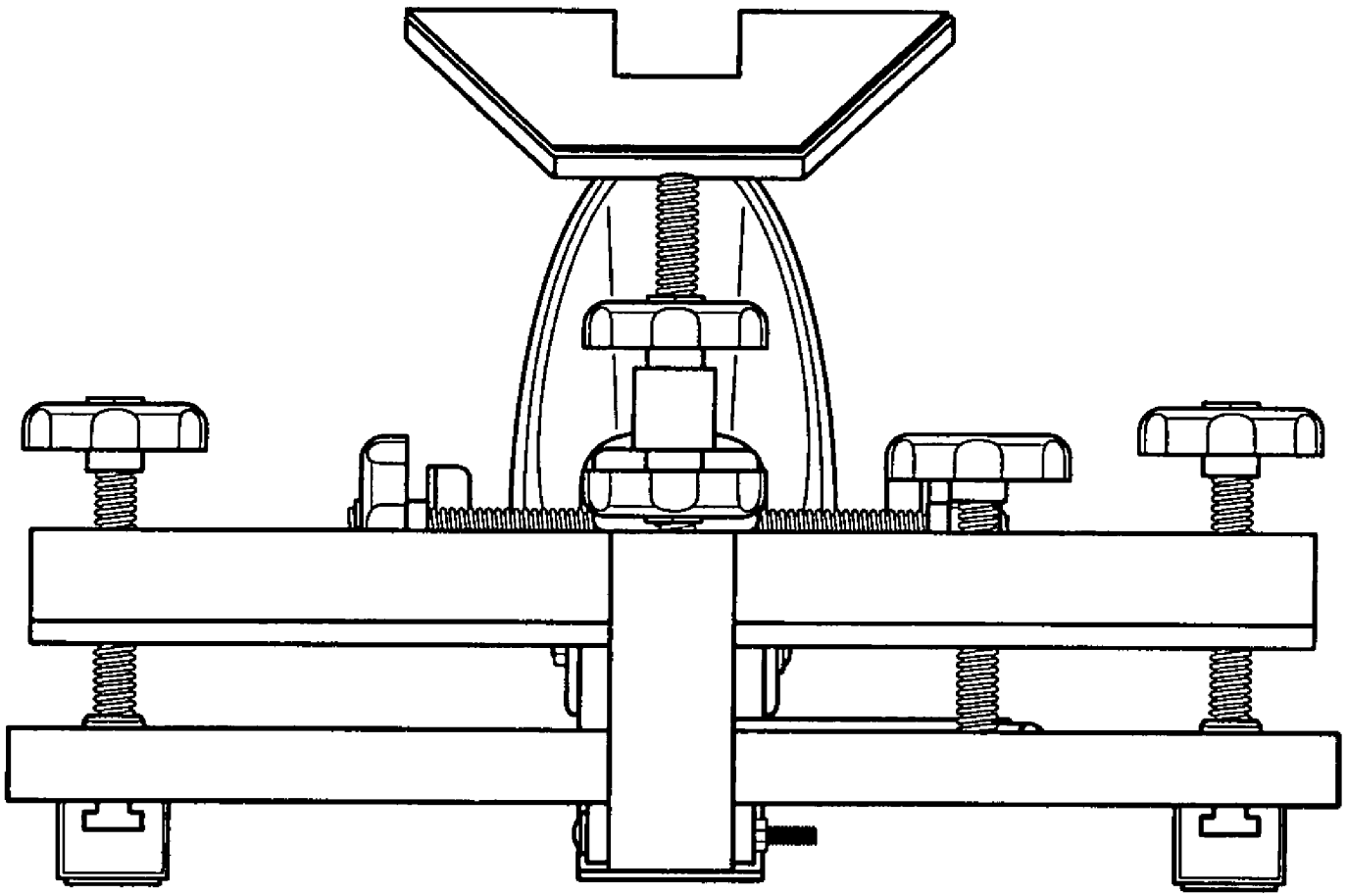
FIG. 6 is a diagrammatic left side elevational view taken generally in the direction of ARROW 6 in FIG. 2.
Figure 7:
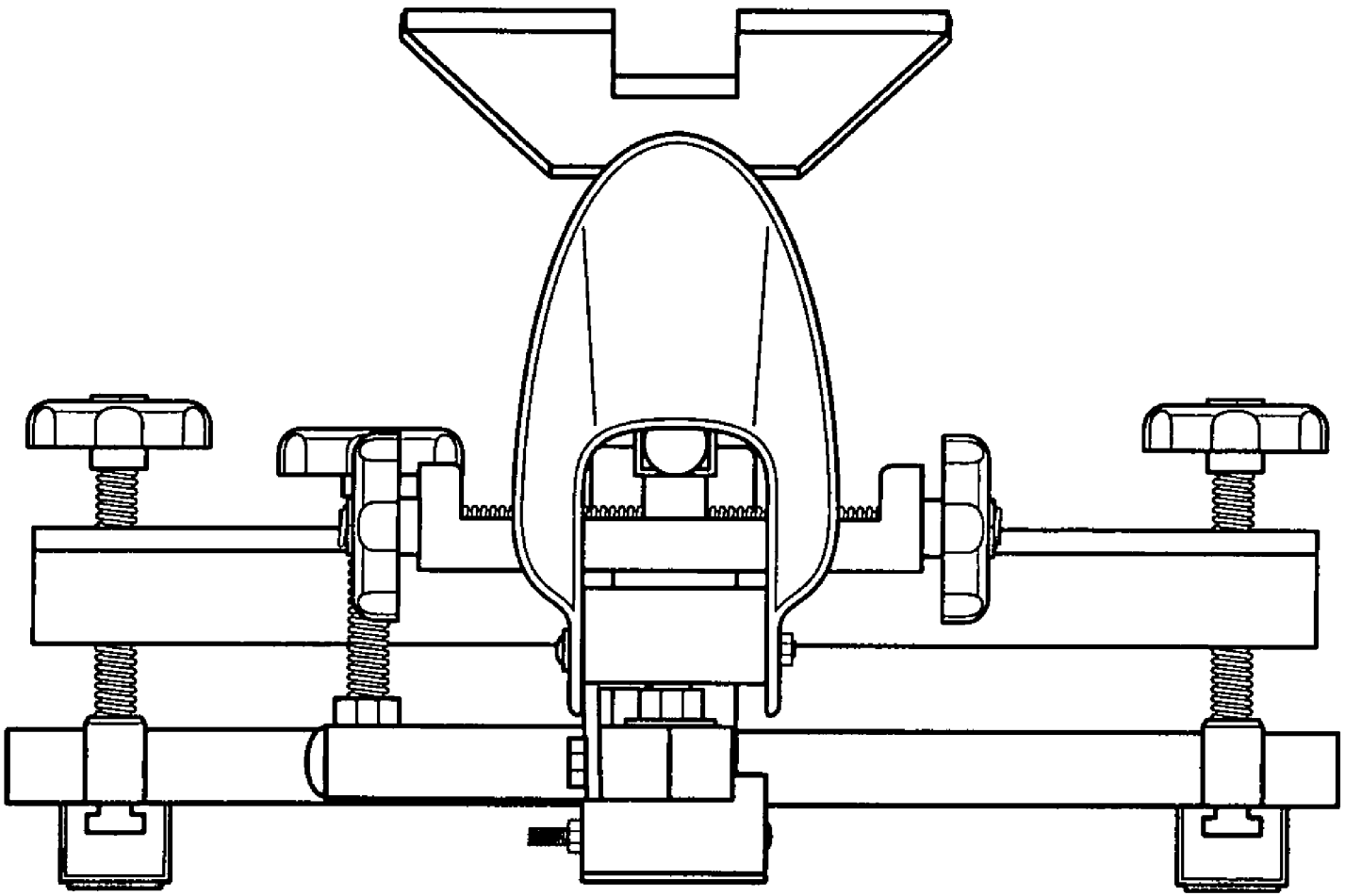
FIG. 7 is a diagrammatic front end view taken generally in the direction of ARROW 7 in FIG. 2.
Figure 8:
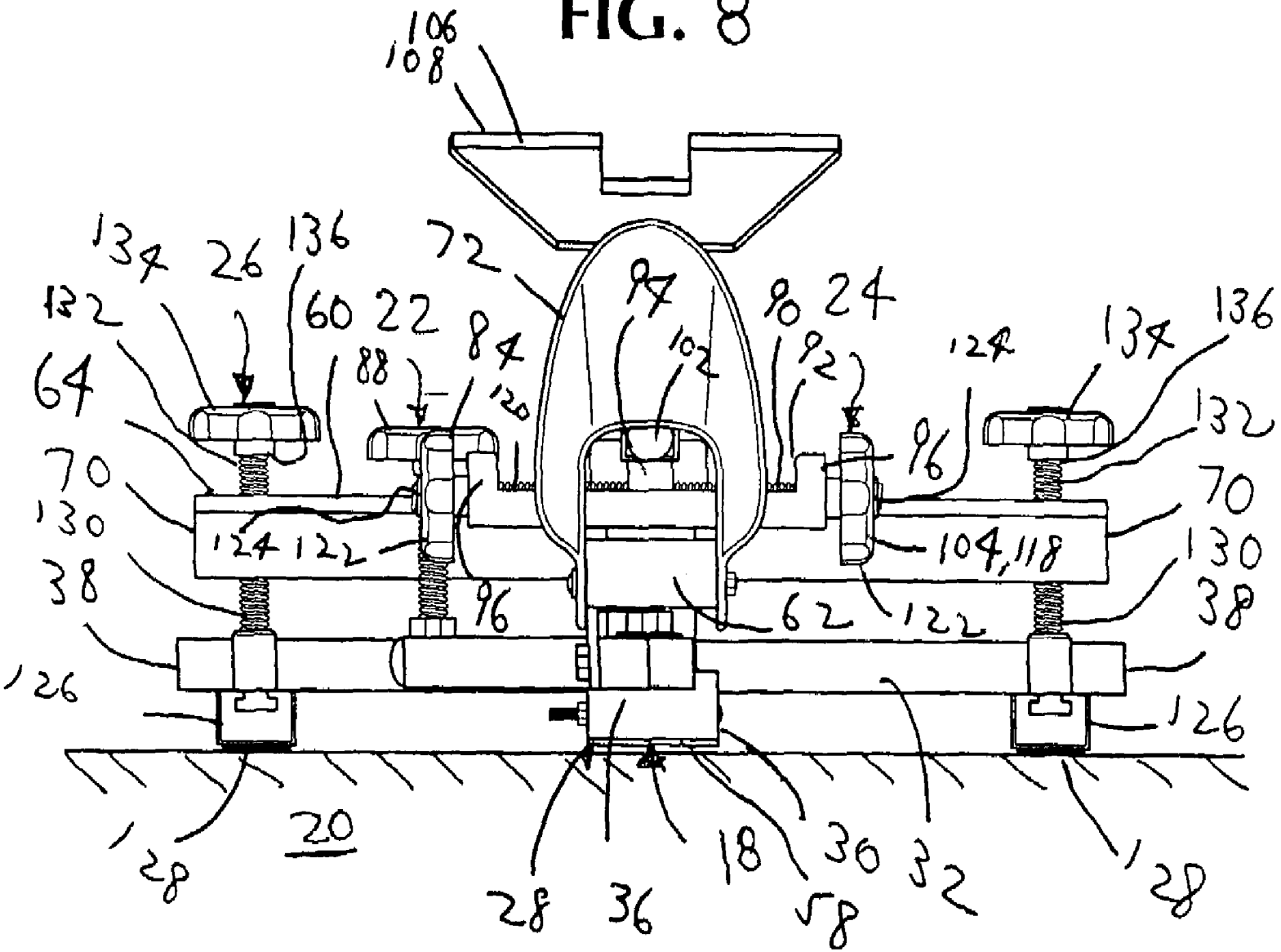
FIG. 8 is a diagrammatic rear end view taken generally in the direction of ARROW 8 in FIG. 2.

The configuration of the gas-dampened recoil rest 14 can best be seen in FIGS. 2-8, which are, respectively, a diagrammatic perspective view of the gas-dampened recoil rest identified by ARROW 2 in FIG. 1, a diagrammatic top plan view taken generally in the direction of ARROW 3 in FIG. 2, a diagrammatic bottom plan view taken generally in the direction of ARROW 4 in FIG. 2, a diagrammatic right side elevational view taken generally in the direction of ARROW 5 in FIG. 2, a diagrammatic left side elevational view taken generally in the direction of ARROW 6 in FIG. 2, a diagrammatic front end view taken generally in the direction of ARROW 7 in FIG. 2, and a diagrammatic rear end view taken generally in the direction of ARROW 8 in FIG. 2, and as such, will be discussed with reference thereto.

The gas-dampened recoil rest 14 comprises a first apparatus 18 for securing the rifle 12 to an unyielding surface 20.

The gas-dampened recoil rest 14 further comprises a second apparatus 22 for adjusting the rifle 12 vertically relative to the unyielding surface 20.

The gas-dampened recoil rest 14 further comprises a third apparatus 24 for windage adjusting the rifle 12 horizontally relative to the unyielding surface 20.

The gas-dampened recoil rest 14 further comprises a fourth apparatus 26 for cant adjusting the rifle 12 relative to the unyielding surface 20.

(1) The First Apparatus 18

The first apparatus 18 comprises a stationary lower frame 28. The stationary lower frame 28 is generally T-shaped and includes a spine 30 and a cross member 32.

The spine 30 of the stationary lower frame 28 is slender, elongated, straight, has a leading end 34 and a trailing end 36, and is for resting on the unyielding surface 20. The cross member 32 of the stationary lower frame 28 is slender, elongated, straight, and extends generally normally across and over the spine 30 of the stationary lower frame 28, closer to the leading end 34 of the spine 30 of the stationary lower frame 28 than the trailing end 36 of the spine 30 of the stationary lower frame 28, and has a pair of terminal ends 38 that are equidistant from the spine 30 of the stationary lower frame 28.

The stationary lower frame 28 further comprises an arm 40. The arm 40 of the stationary lower frame 28 is generally L-shaped and includes an extender 42 and a grip 44. The extender 42 of the arm 40 of the stationary lower frame 28 is slender, elongated, straight, and extends length-adjustably from the leading end 34 of the spine 30 of the stationary lower frame 28 to a terminal end 46. The grip 44 of the arm 40 of the stationary lower frame 28 is slender, elongated, straight, and depends generally normally from the terminal end 46 of the extender 42 of the arm 40 of the stationary lower frame 28 and is for gripping an end 48 of the unyielding surface 20, with the extender 42 of the arm 40 of the stationary lower frame 28 being length adjusted accordingly to thereby affix a leading end 50 of the stationary lower frame 28 to the unyielding surface 20.

The stationary lower frame 28 further comprises a flange 52. The flange 52 of the stationary lower frame 28 is flat, extends rearwardly from the trailing end 36 of the spine 30 of the stationary lower frame 28, and has a through bore 54 for receiving a fastener 56 for engaging into the unyielding surface 20 to thereby affix a trailing end 58 of the stationary lower frame 28 to the unyielding surface 20.

(2) The Second Apparatus 22

The second apparatus 22 comprises a movable carrier frame 60. The movable carrier frame 60 is generally T-shaped and includes a spine 62 and a cross member 64.

The spine 62 of the movable carrier frame 60 is slender, elongated, straight, has a leading end 66 and a trailing end 68, and is vertically pivotally attached to the spine 30 of the stationary lower frame 28. The cross member 64 of the movable carrier frame 60 is slender, elongated, arcuate, and extends generally normally across the spine 62 of the movable carrier frame 60, at the leading end 66 of the spine 62 of the movable carrier frame 60, and has a pair of terminal ends 70 that are equidistant from the spine 62 of the movable carrier frame 60.

The trailing end 68 of the spine 62 of the movable carrier frame 60 is vertically pivotally attached to the spine 30 of the stationary lower frame 28, closer to the trailing end 36 of the spine 30 of the stationary lower frame 28 than the leading end 36 of the spine 30 of the stationary lower frame 28.

The movable carrier frame 60 further comprises a butt socket 72. The butt socket 72 of the movable carrier frame 60 is affixed to the trailing end 68 of the spine 62 of the movable carrier frame 60 and is for receiving the butt of the rifle 12.

The movable carrier frame 60 further comprises a gas damper 74. The gas damper 74 of the movable carrier frame 60 is affixed, at a fixed end 76 thereof, to the spine 30 of the stationary lower frame 28 and, at a movable end 78 thereof, to the spine 62 of the movable carrier frame 60, and is for absorbing recoil when the rifle 12 is fired.

The movable carrier frame 60 further comprises a telescopic arm 80. The telescopic arm 80 of the movable carrier frame 60 is pivotally attached, at a rear end 82 thereof, to the trailing end 68 of the spine 62 of the movable carrier frame 60 and vertically adjustably affixed, at a front end 83 thereof, through a first adjusting screw assembly 84, to the cross member 64 of the movable carrier frame 60, in proximity to a terminal end 70 of the cross member 64 of the movable carrier frame 60.

The first adjusting screw assembly 84 of the movable carrier frame 60 comprises a tab 86 and an adjusting screw 88. The tab 86 of the first adjusting screw assembly 84 of the movable carrier frame 60 extends rearwardly from the cross member 64 of the movable carrier frame 60, in proximity to the terminal end 70 of the cross member 64 of the movable carrier frame 60. The adjusting screw 88 of the first adjusting screw assembly 84 of the movable carrier frame 60 depends threadably through the tab 86 of the first adjusting screw assembly 84 of the movable carrier frame 60 and fixedly to the front end 83 of the telescopic arm 80 of the movable carrier frame 60.

(3) The Third Apparatus 24

The third apparatus 24 comprises a frame 90. The frame 90 is generally T-shaped and includes a cross member 92 and a telescopic arm 94.

The cross member 92 of the frame 90 is slender, elongated, generally U-shaped, extends generally normally across the spine 62 of the movable carrier frame 60, closer to the leading end 66 of the spine 62 of the movable carrier frame 60 than the trailing end 68 of the spine 62 of the movable carrier frame 60, and has a pair of terminal ends 96 that are equidistant from the spine 62 of the movable carrier frame 60.

The telescopic arm 94 of the frame 90 is pivotally attached to and over, at a front end 98 thereof, the cross member 64 of the movable carrier frame 60, at a center 100 thereof, and horizontally adjustably affixed, at a rear end 102 thereof, through a second adjusting screw assembly 104, to the cross member 92 of the frame 90.

The frame 90 further comprises a front rest 106. The front rest 106 of the frame 90 comprises a padded rest 108 and a third adjusting screw assembly 110. The third adjusting screw assembly 110 of the front rest 106 of the frame 90 comprises a threaded rod 112 and a pair of second knobs 114. The threaded rod 112 of the third adjusting screw assembly 110 of the front rest 106 of the frame 90 passes freely through the front end 98 of the telescopic arm 94 of the frame 90, with the padded rest 108 of the front rest 106 of the frame 90 disposed on an upper terminal end 116 of the threaded rod 112 of the third adjusting screw assembly 110 of the front rest 106 of the frame 90, and with the pair of second knobs 114 threaded on the threaded rod 112 of the third adjusting screw assembly 110 of the front rest 106 of the frame 90, straddling the front end 98 of the telescopic arm 94 of the frame 90, and tightened thereagainst, when the padded rest 108 of the front rest 106 of the frame 90 with the rifle 12 resting therein is at a desired elevation.

The second adjusting screw assembly 104 of the frame 90 comprises an adjusting screw 118. The adjusting screw 118 of the second adjusting screw assembly 104 of the frame 90 comprises a threaded rod 120 and a pair of third knobs 122. The threaded rod 120 of the adjusting screw 118 of the second adjusting screw assembly 104 of the frame 90 extends threadably through the rear end 102 of the telescopic arm 94 of the frame 90, rotatably through the pair of terminal ends 96 of the cross member 92 of the frame 90 to a pair of terminal ends 124 thereof that are fixedly attached to the pair of third knobs 122 of the adjusting screw 118 of the second adjusting screw assembly 104 of the frame 90, respectively, and when a third knob 122 of the adjusting screw 118 of the second adjusting screw assembly 104 of the frame 90 is manually rotated, the rear end 102 of the telescopic arm 94 of the frame 90 threads along the threaded rod 120 of the adjusting screw 118 of the second adjusting screw assembly 104 of the frame 90 to thereby cause the telescopic arm 94 of the frame 90 to horizontally pivot about the rear end 102 of the telescopic arm 94 of the frame 90 horizontally and move the front rest 106 of the frame 90 therewith.

(4) The Fourth Apparatus 26

The fourth apparatus 26 comprises a pair of fourth adjusting screw assemblies 126. The pair of fourth adjusting screw assemblies 126 comprise a pair of bases 128, respectively, and a pair of adjusting screws 130, respectively. The pair of bases 128 of the pair of fourth adjusting screw assemblies 126 are slender, elongated, and extend normally rearwardly from and under the pair of terminal ends 38 of the cross member 32 of the stationary lower frame 28, respectively.

The pair of adjusting screws 130 of the pair of fourth adjusting screw assemblies 126 comprise a pair of threaded rods 132, respectively, and a pair of fourth knobs 134, respectively. The pair of threaded rods 132 of the pair of adjusting screws 130 of the pair of fourth adjusting screw assemblies 126 extend threadably through the pair of terminal ends 70 of the cross member 64 of the movable carrier frame 60, respectively, to operatively engage against the pair of bases 128 of the pair of fourth adjusting screw assemblies 126, respectively. The pair of fourth knobs 134 of the pair of adjusting screws 130 of the pair of fourth adjusting screw assemblies 126 fixedly engage upper ends 136 of the pair of threaded rods 132 of the pair of adjusting screws 130 of the pair of fourth adjusting screw assemblies 126, respectively, and when a fourth knob 134 of an associated adjusting screw 130 of an associated fourth adjusting screw assembly 126 is manually rotated, an associated terminal end 70 of the cross member 64 of the movable carrier frame 60 threads along an associated threaded rod 132 of the associated adjusting screw 130 of the associated fourth adjusting screw assembly 126, to thereby cause the cross member 64 of the movable carrier frame 60 to cant and cant the front rest 106 of the frame 90 therewith.

C. The Remote Trigger Release 16

Figure 9:
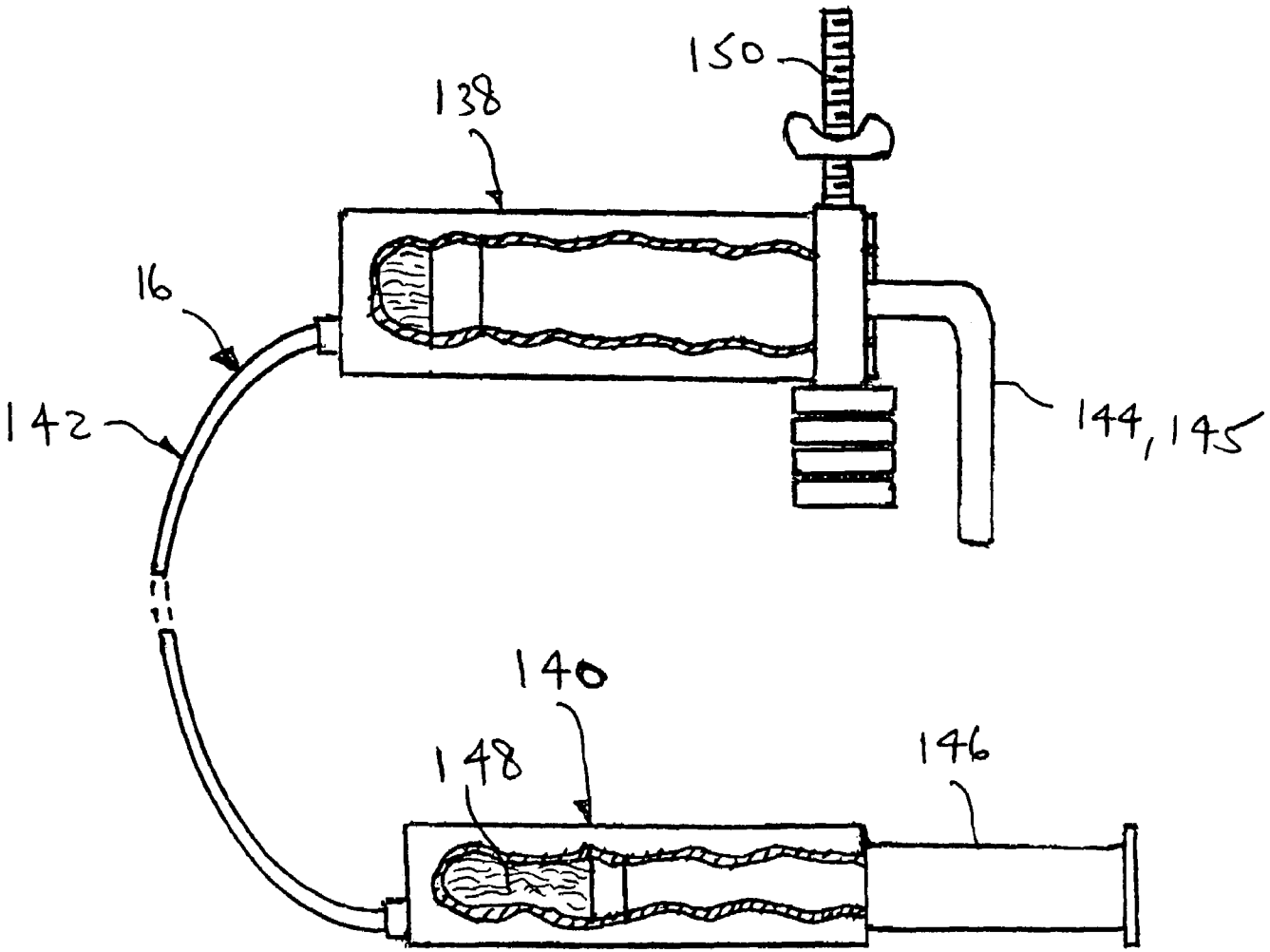
FIG. 9 is an enlarged diagrammatic side elevational view in partial section of the remote trigger release identified by ARROW 9 in FIG. 1.

The configuration of the remote trigger release 16 can best be seen in FIG. 9, which is an enlarged diagrammatic side elevational view in partial section of the remote trigger release identified by ARROW 9 in FIG. 1, and as such, will be discussed with reference thereto.

The remote trigger release 16 comprises a slave cylinder 138, a master cylinder 140, and a conduit 142. The slave cylinder 138 is for operatively connecting to the trigger of the rifle 12. The master cylinder 140 is in fluid communication with the slave cylinder 138 via the conduit 142 and is for positioning remote from the trigger of the rifle 12 so as to allow the slave cylinder 138 to activate and activate the trigger of the rifle 12 when the master cylinder 140 is activated remotely to thereby eliminate any human contact and possible motion contamination.

The slave cylinder 138 has a trigger-activating plunger 144 that is a normally bent rod 145 for operatively connecting to the trigger of the rifle 12. The master cylinder 140 has a plunger 146 for manually depressing by the shooter to activate the master cylinder 140, and when the plunger 146 of the master cylinder 140 is depressed, hydraulic fluid 148 leaves the master cylinder 140, flows through the conduit 142 into the slave cylinder 138, where it pushes the normally bent rod

145 of the trigger activating plunger 144 of the slave cylinder 138 out to activate the trigger of the rifle 12.

The remote trigger release 16 further comprises a clamp assembly 150. The clamp assembly 150 is operatively connected to the slave cylinder 138 and is for attaching the slave cylinder 138 to the trigger guard of the rifle 12 in such a position so as allow the normally bent rod 145 of the trigger-activating plunger 144 of the slave cylinder 138 to engage the trigger of the rifle 12.

D. Conclusions

It will be understood that each of the elements described above or two or more together may also find a useful application in other types of constructions differing from the types described above.

While the embodiments of the present invention have been illustrated and described as embodied in a gas-dampened recoil rest with remote trigger release for a rifle for allowing a shooter to fire the rifle without any human contact and possible motion contamination, however, they are not limited to the details shown, since it will be understood that various omissions, modifications, substitutions, and changes in the forms and details of the embodiments of the present invention illustrated and their operation can be made by those skilled in the art without departing in any way from the spirit of the embodiments of the present invention.

Without further analysis the foregoing will so fully reveal the gist of the embodiments of the present invention that others can by applying current knowledge readily adapt them for various applications without omitting features that from the standpoint of prior art fairly constitute characteristics of the generic or specific aspects of the embodiments of the present invention.

The invention claimed is:

1. A gas-dampened recoil rest with remote trigger release for a rifle, comprising:

a) a gas-dampened recoil rest; and b) a remote trigger release;

wherein said gas-dampened recoil rest is for stationarily receiving the rifle;

wherein said remote trigger release is for operatively connecting to the rifle;

wherein the rifle has a trigger;

wherein said remote trigger release comprises a slave cylinder;

wherein said remote trigger release comprises a master cylinder;

wherein said remote trigger release comprises a conduit;

wherein said slave cylinder is for operatively connecting to the trigger of the rifle;

wherein said master cylinder is in fluid communication with said slave cylinder via said conduit; and wherein said master cylinder is for positioning remote from the trigger of the rifle so as to allow said slave cylinder to activate and activate the trigger of the rifle when said master cylinder is activated remotely.

2. The rest of claim 1, wherein said gas-dampened recoil rest comprises means for securing the rifle to a surface.

3. The rest of claim 2, wherein said gas-dampened recoil rest comprises means for windage adjusting the rifle horizontally relative to the surface.

4. The rest of claim 3, wherein said gas-dampened recoil rest comprises means for adjusting cant of the rifle relative to the surface.

5. The rest of claim 4, wherein said securing means includes a stationary lower frame;

wherein said stationary lower frame is generally T-shaped;

wherein said stationary lower frame includes a spine; and wherein said stationary lower frame includes a cross member.

6. The rest of claim 5, wherein said spine of said stationary lower frame is slender;

wherein said spine of said stationary lower frame is elongated;

wherein said spine of said stationary lower frame is straight;

wherein said spine of said stationary lower frame has a leading end;

wherein said spine of said stationary lower frame has a trailing end; and wherein said spine of said stationary lower frame is for resting on the surface.

7. The rest of claim 6, wherein said cross member of said stationary lower frame is slender;

wherein said cross member of said stationary lower frame is elongated;

wherein said cross member of said stationary lower frame is straight;

wherein said cross member of said stationary lower frame extends generally normally across said spine of said stationary lower frame;

wherein said cross member of said stationary lower frame is closer to said leading end of said spine of said stationary lower frame than said trailing end of said spine of said stationary lower frame;

wherein said cross member of said stationary lower frame extends over said spine of said stationary lower frame;

wherein said cross member of said stationary lower frame has a pair of terminal ends; and wherein said pair of terminal ends of said cross member of said stationary lower frame are equidistant from said spine of said stationary lower frame.

8. The rest of claim 7, wherein said cant adjusting means comprises a pair of adjusting screw assemblies;

wherein said pair of adjusting screw assemblies comprise a pair of bases, respectively; and wherein said pair of adjusting screw assemblies comprise a pair of adjusting screws, respectively.

9. The rest of claim 8, wherein said pair of bases of said pair of adjusting screw assemblies are slender;

wherein said pair of bases of said pair of adjusting screw assemblies are elongated;

wherein said pair of bases of said pair of adjusting screw assemblies are straight;

wherein said pair of bases of said pair of adjusting screw assemblies extend normally rearwardly from said pair of terminal ends of said cross member of said stationary lower frame, respectively; and wherein said pair of bases of said pair of adjusting screw assemblies extend under said pair of terminal ends of said cross member of said stationary lower frame, respectively.

10. The rest of claim 6, wherein said stationary lower frame comprises an arm;

wherein said arm of said stationary lower frame is generally L-shaped;

wherein said arm of said stationary lower frame includes an extender; and wherein said arm of said stationary lower frame includes a grip.

11. The rest of claim 10, wherein said extender of said arm of said stationary lower frame is slender;

wherein said extender of said arm of said stationary lower frame is elongated;

wherein said extender of said arm of said stationary lower frame is straight; and wherein said extender of said arm of said stationary lower frame extends length-adjustably from said leading end of said spine of said stationary lower frame to a terminal end.

12. The rest of claim 11, wherein said grip of said arm of said stationary lower frame is slender;

wherein said grip of said arm of said stationary lower frame is elongated;

wherein said grip of said arm of said stationary lower frame is straight;

wherein said grip of said arm of said stationary lower frame depends generally normally from said terminal end of said extender of said arm of said stationary lower frame; and wherein said extender of said arm of said stationary lower frame is length adjusted accordingly to thereby affix a leading end of said stationary lower frame to the surface.

13. The rest of claim 6, wherein said stationary lower frame comprises a flange;

wherein said flange of said stationary lower frame is flat;

wherein said flange of said stationary lower frame extends rearwardly from said trailing end of said spine of said stationary lower frame;

wherein said flange of said stationary lower frame and has a through bore; and wherein said through bore through said flange of said stationary lower frame is for receiving a fastener for engaging into the surface to thereby affix a trailing end of said stationary lower frame to the surface.

14. The rest of claim 6, wherein said vertical adjusting means includes a movable carrier frame;

wherein said movable carrier frame is generally T-shaped;

wherein said movable carrier frame includes a spine; and wherein said movable carrier frame includes a cross member.

15. The rest of claim 14, wherein said spine of said movable carrier frame is slender;

wherein said spine of said movable carrier frame is elongated;

wherein said spine of said movable carrier frame is straight;

wherein said spine of said movable carrier frame has a leading end;

wherein said spine of said movable carrier frame has a trailing end; and wherein said spine of said movable carrier frame is vertically pivotally attached to said spine of said stationary lower frame.

16. The rest of claim 15, wherein said cross member of said movable carrier frame is slender;

wherein said cross member of said movable carrier frame is elongated;

wherein said cross member of said movable carrier frame is arcuate;

wherein said cross member of said movable carrier frame extends generally normally across said spine of said movable carrier frame;

wherein said cross member of said movable carrier frame extends at said leading end of said spine of said movable carrier frame;

wherein said cross member of said movable carrier frame has a pair of terminal ends; and wherein said pair of terminal ends of said cross member of said movable carrier frame are equidistant from said spine of said movable carrier frame.

17. The rest of claim 16, wherein said movable carrier frame comprises a telescopic arm;

wherein said telescopic arm of said movable carrier frame is pivotally attached, at a rear end thereof, to said trailing end of said spine of said movable carrier frame and vertically adjustably affixed, at a front end thereof, through a first adjusting screw assembly, to said cross member of said movable carrier frame; and wherein said front end of said telescopic arm of said movable carrier frame is in proximity to a terminal end of said cross member of said movable carrier frame.

18. The rest of claim 17, wherein said first adjusting screw assembly of said movable carrier frame comprises a tab;

wherein said first adjusting screw assembly of said movable carrier frame comprises an adjusting screw;

wherein said tab of said first adjusting screw assembly of said movable carrier frame extends rearwardly from said cross member of said movable carrier frame;

wherein said tab of said first adjusting screw assembly of said movable carrier frame is in proximity to said terminal end of said cross member of said movable carrier frame; and wherein said adjusting screw of said first adjusting screw assembly of said movable carrier frame depends threadably through said tab of said first adjusting screw assembly of said movable carrier frame and fixedly to said front end of said telescopic arm of said movable carrier frame.

19. The rest of claim 16, wherein said horizontal adjusting means includes a frame;

wherein said frame is generally T-shaped;

wherein said frame includes a cross member; and wherein said frame includes a telescopic arm.

20. The rest of claim 19, wherein said cross member of said frame is slender;

wherein said cross member of said frame is elongated;

wherein said cross member of said frame is straight;

wherein said cross member of said frame is generally U-shaped;

wherein said cross member of said frame extends generally normally across said spine of said movable carrier frame;

wherein said cross member of said frame is closer to said leading end of said spine of said movable carrier frame than said trailing end of said spine of said movable carrier frame;

wherein said cross member of said frame has a pair of terminal ends; and wherein said pair of terminal ends of said cross member of said frame are equidistant from said spine of said movable carrier frame.

21. The rest of claim 20, wherein said telescopic arm of said frame is pivotally attached to, at a front end thereof, said cross member of said movable carrier frame, at a center thereof;

wherein said telescopic arm of said frame is pivotally attached over said cross member of said movable carrier frame; and wherein said telescopic arm of said frame is horizontally adjustably affixed, at a rear end thereof, through a second adjusting screw assembly, to said cross member of said frame.

22. The rest of claim 21, wherein said frame comprises a front rest;

wherein said front rest of said frame comprises a padded rest; and wherein said front rest of said frame comprises a third adjusting screw assembly.

23. The rest of claim 22, wherein said third adjusting screw assembly of said front rest of said frame comprises a threaded rod;

wherein said third adjusting screw assembly of said front rest of said frame comprises a pair of second knobs;

wherein said threaded rod of said third adjusting screw assembly of said front rest of said frame passes freely through said front end of said telescopic arm of said frame;

wherein said padded rest of said front rest of said frame is disposed on an upper terminal end of said threaded rod of said third adjusting screw assembly of said front rest of said frame;

wherein said pair of second knobs of said third adjusting screw assembly of said front rest of said frame are threaded on said threaded rod of said third adjusting screw assembly of said front rest of said frame; and wherein said pair of second knobs of said third adjusting screw assembly of said front rest of said frame straddle said front end of said telescopic arm of said frame, and are tightened thereagainst, when said padded rest of said front rest of said frame with the rifle resting therein is at a desired elevation.

24. The rest of claim 22, wherein said second adjusting screw assembly of said frame comprises an adjusting screw;

wherein said adjusting screw of said second adjusting screw assembly of said frame comprises a threaded rod;

wherein said adjusting screw of said second adjusting screw assembly of said frame comprises a pair of third knobs;

wherein said threaded rod of said adjusting screw of said second adjusting screw assembly of said frame extends threadably through said rear end of said telescopic arm of said frame;

wherein said threaded rod of said adjusting screw of said second adjusting screw assembly of said frame extends rotatably through said pair of terminal ends of said cross member of said frame to a pair of terminal ends thereof; and wherein said pair of terminal ends of said threaded rod of said adjusting screw of said second adjusting screw assembly of said frame are fixedly attached to said pair of third knobs of said adjusting screw of said second adjusting screw assembly of said frame, and when a third knob of said adjusting screw of said second adjusting screw assembly of said frame is manually rotated, said rear end of said telescopic arm of said frame threads along said threaded rod of said adjusting screw of said second adjusting screw assembly of said frame to thereby cause said telescopic arm of said frame to horizontally pivot about said rear end of said telescopic arm of said frame horizontally and move said front rest of said frame therewith.

25. The rest of claim 22, wherein said pair of adjusting screws of said pair of adjusting screw assemblies comprise a pair of threaded rods, respectively;

wherein said pair of adjusting screws of said pair of adjusting screw assemblies comprise pair of knobs respectively;

wherein said pair of threaded rods of said pair of adjusting screws of said pair of adjusting screw assemblies extend threadably through said pair of terminal ends of said cross member of said movable carrier frame, respectively, to operatively engage against said pair of bases of said pair of adjusting screw assemblies, respectively; and wherein said pair of knobs of said pair of adjusting screws of said pair of adjusting screw assemblies fixedly engage upper ends of said pair of threaded rods of said pair of adjusting screws of said pair of adjusting screw assemblies, respectively, and when a knob of an associated adjusting screw of an associated adjusting screw assembly is manually rotated, an associated terminal end of said cross member of said movable carrier frame threads along an associated threaded rod of said associated adjusting screw of said associated adjusting screw assembly to thereby cause said cross member of said movable carrier frame to cant and cant said front rest of said frame therewith.

26. The rest of claim 15, wherein said trailing end of said spine of said movable carrier frame is vertically pivotally attached to said spine of said stationary lower frame; and wherein said trailing end of said spine of said movable carrier frame is closer to said trailing end of said spine of said stationary lower frame than said leading end of said spine of said stationary lower frame.

27. The rest of claim 15, wherein the rifle has a butt;

wherein said movable carrier frame comprises a butt socket;

wherein said butt socket of said movable carrier frame is affixed to said trailing end of said spine of said movable carrier frame; and wherein said butt socket of said movable carrier frame is for receiving the butt of the rifle.

28. The rest of claim 14, wherein said movable carrier frame comprises a gas damper;

wherein said gas damper of said movable carrier frame is affixed, at a fixed end thereof, to said spine of said stationary lower frame and, at a movable end thereof, to said spine of said movable carrier frame; and wherein said gas damper of said movable carrier frame is for absorbing recoil when the rifle is fired.

29. The rest of claim 1, wherein said gas-dampened recoil rest comprises means for adjusting the rifle vertically relative to the surface.

30. The rest of claim 1, wherein said slave cylinder has a trigger-activating plunger;

wherein said trigger-activating plunger of said slave cylinder is a normally bent rod; and wherein said normally bent rod of said trigger-activating plunger of said slave cylinder is for operatively connecting to the trigger of the rifle.

31. The rest of claim 30, wherein said master cylinder has a plunger; and wherein said plunger of said master cylinder is for manually depressing by the shooter to activate said master cylinder, and when said plunger of said master cylinder is depressed, hydraulic fluid leaves said master cylinder, flows through said conduit into said slave cylinder, where it pushes said normally bent rod of said trigger activating plunger of said slave cylinder out to activate the trigger of the rifle.

32. The rest of claim 30, wherein the rifle has a trigger guard;

wherein said remote trigger release comprises a clamp assembly;

wherein said clamp assembly is operatively connected to said slave cylinder; and wherein said clamp assembly is for attaching said slave cylinder to the trigger guard of the rifle in such a position so as allow said normally bent rod of said trigger-activating plunger of said slave cylinder to engage the trigger of the rifle.

* * * * *